US006840219B2

(12) United States Patent
Joos et al.

(10) Patent No.: US 6,840,219 B2
(45) Date of Patent: Jan. 11, 2005

(54) FUEL SUPPLY SYSTEM FOR AN INTERNAL COMBUSTION ENGINE

(75) Inventors: Klaus Joos, Walheim (DE); Jens Wolber, Gerlingen (DE); Thomas Frenz, Noerdlingen (DE); Hansjoerg Bochum, Leinfelden (DE); Markus Amler, Leonberg-Gebersheim (DE)

(73) Assignee: Robert Bosch GmbH, Stuttgart (DE)

( * ) Notice: Subject to any disclaimer, the term of this patent is extended or adjusted under 35 U.S.C. 154(b) by 129 days.

(21) Appl. No.: 09/890,331

(22) PCT Filed: Nov. 30, 2000

(86) PCT No.: PCT/DE00/04256

§ 371 (c)(1),
(2), (4) Date: Jan. 17, 2002

(87) PCT Pub. No.: WO01/40638

PCT Pub. Date: Jun. 7, 2001

(65) Prior Publication Data

US 2002/0170508 A1 Nov. 21, 2002

(30) Foreign Application Priority Data

Dec. 1, 1999 (DE) ..... 199 57 742

(51) Int. Cl.[7] ..... F02M 37/04
(52) U.S. Cl. ..... 123/456; 123/41.31; 123/541
(58) Field of Search ..... 123/41.31, 541, 123/446, 514, 179.17, 456

(56) References Cited

U.S. PATENT DOCUMENTS

| | | | | | |
|---|---|---|---|---|---|
| 4,869,218 | A | * | 9/1989 | Fehlmann et al. | 123/357 |
| 4,915,063 | A | * | 4/1990 | Stumpf | 123/41.31 |
| 5,647,331 | A | * | 7/1997 | Swanson | 123/516 |
| 5,908,020 | A | * | 6/1999 | Boutwell et al. | 123/541 |
| 6,009,859 | A | * | 1/2000 | Roche et al. | 123/509 |
| 6,247,441 | B1 | * | 6/2001 | Sato et al. | 123/198 |

FOREIGN PATENT DOCUMENTS

| | | | | |
|---|---|---|---|---|
| DE | 19818421 | * | 10/1999 | 123/456 |

* cited by examiner

*Primary Examiner*—Carl S. Miller
(74) *Attorney, Agent, or Firm*—Ronald E. Greigg

(57) ABSTRACT

A fuel delivery system for an internal combustion engine, having a fuel feed pump, which delivers fuel which is at pilot pressure to a high-pressure fuel pump that communicates on the high-pressure side with at least one injection valve, in order to deliver fuel at high pressure to the injection valve or valves. To prevent vapor bubble development in the high-pressure fuel pump, which impairs its pumping capacity and pressure generation, a coolant medium flow can be delivered to the high-pressure fuel pump via at least one coolant conduit, in order to keep the temperature ($T_{HDP}$) of the high-pressure fuel pump below a critical operating temperature ($T_{k1}$).

20 Claims, 3 Drawing Sheets

FUEL SUPPLY SYSTEM FOR AN INTERNAL COMBUSTION ENGINE

CROSS-REFERENCE TO RELATED APPLICATIONS

This application is a 35 USC 371 application of PCT/DE 00/04256 filed on Nov. 30, 2000.

BACKGROUND OF THE INVENTION

1. Field of the Invention

The invention relates to a fuel delivery system for an internal combustion engine for delivering fuel at high pressure to the injector valves of the engine.

2. Brief Description of the Prior Art

From German Patent Disclosure DE 195 39 885 A1, a fuel delivery system for an internal combustion engine is already known which has a fuel feed pump and connected in series with it a high-pressure fuel pump, so that fuel at high pressure can be furnished from the high-pressure side of the high-pressure fuel pump, via a pressure line, a reservoir and valve lines, to injection valves, each of which injects fuel directly into one of the combustion chambers of the engine. The fuel feed pump, whose outlet side communicates with the low-pressure side of the high-pressure fuel pump via a pressure line, furnishes fuel that is at pilot pressure to the high-pressure fuel pump.

To keep the pilot pressure in the pressure line at a desire value, a pressure limiting valve is connected to the pressure line via a 2/2-way valve, which either blocks or opens the communication between the pressure line and the pressure limiting valve.

To compensate for the low pumping capacity of the high-pressure fuel pump during the engine starting phase and optionally to scavenge the pressure line on the high-pressure side and the adjoining reservoir so as to enable removing gas bubbles that are created while the engine is stopped, an admission device is provided parallel to the high-pressure fuel pump and connects the low-pressure side and the high-pressure side of the high-pressure fuel pump to one another. To raise the pilot pressure in the pressure line on the low-pressure side to 8–10 bar during the starting phase, compared with the pilot pressure during normal operation, the 2/2-way valve can be closed, so that no fuel can flow out of the pressure line. The elevated pilot pressure during the starting phase makes it possible on the one hand to scavenge the fuel delivery lines to eliminate gas bubbles and on the other to compress gas bubbles, as well as enabling a high pumping capacity that is suitable for a starting event.

During normal operation of the engine, the injection pressure is generated in the reservoir by the high-pressure fuel pump and is limited by a controllable pressure regulating valve to an appropriate value. To that end, the pressure regulating valve communicates with the low-pressure side via a return line.

However, a limitation of the temperature of the high-pressure fuel pump is effected at best only by a certain cooling by means of the fuel flow through the high-pressure fuel pump, so that it cannot reliably be prevented that the high-pressure fuel pump will heat up enough that its temperature exceeds the critical operating temperature, that is, the temperature at which, for a given pilot pressure, fuel vapor bubble development begins.

In another fuel delivery system, in which a high-pressure fuel pump for supplying direct injection valves is supplied with fuel at pilot pressure by a fuel feed pump, it is provided that the pressure line connecting the pumping side of the fuel feed pump to the low-pressure side of the high-pressure fuel pump communicates via a variable throttle valve with a first pressure limiting valve for a first, relatively low pressure, such as 3 bar, and communicates directly with a second pressure limiting valve for a relatively high pilot pressure, such as 9 bar. The variable throttle valve has a flow resistance which increases disproportionately as the flow rate increases, so that the pilot pressure in the pressure line can be adjusted by means of the pumping capacity of the fuel feed pump.

In order to prevent vapor bubble development in the high-pressure fuel pump when the fuel temperature is rising, it is possible in this fuel delivery system, by increasing the pumping capacity of the fuel feed pump, to raise the pilot pressure such that it becomes greater than the temperature-dependent vapor pressure of the fuel in the pressure line.

In this way, it is true that the vapor bubble development in the fuel and hence a drop in the pumping capacity of the high-pressure fuel pump, which would make any further buildup of high pressure impossible can indeed be prevented. However, the fuel feed pump would be stressed considerably by such an operating mode, which would reduce its service life.

From German Patent Disclosure DE 38 36 507 A1, for cooling a control motor of a throttle valve adjusting unit it is known for a flow of coolant water for the control motor to be diverted from the engine coolant system.

SUMMARY OF THE INVENTION

The fuel delivery system according to this invention has the advantage over the prior art that with the aid of the coolant medium flow, the high-pressure fuel pump can be kept at a temperature level which is below a critical operating temperature of the high-pressure fuel pump. To that end, one or more suitable coolant conduits should be provided, which furnish an appropriate coolant medium flow, which assures adequate heat dissipation, to the high-pressure fuel pump.

Preferably air serves as the coolant medium. If the fuel delivery system of the invention is used in a vehicle engine, then it is possible to dispose the coolant conduits in the engine compartment in such a way that the ambient air, which during vehicle operation is carried from the vehicle surroundings to the high-pressure fuel pump, will suffice for cooling.

However, it is especially expedient if a fan is associated with the at least one coolant conduit, for generating the cooling air flow through the coolant conduit; preferably, the fan is controllable as a function of the temperature of the high-pressure fuel pump and the critical operating temperature. In this way, the cooling air flow can be controlled independently of the range of use of the engine in such a way that suitable cooling of the high-pressure fuel pump can always be achieved.

If the fuel delivery system of the invention, in addition to the coolant media for the high-pressure fuel pump, has a reversible or variable pressure regulator device, then by means of a suitably highly set pilot pressure, the critical operating temperature of the high-pressure fuel pump can be increased so far that cooling of the high-pressure fuel pump, with the aid of the cooling air flow carried purposefully through the coolant conduit or coolant conduits, which stream is optionally generated with the aid of a preferably controllable fan, is adequate under all operating conditions of the engine.

By the cooling, provided according to the invention, of the high-pressure fuel pump with a separate coolant medium, vapor bubble development in the high-pressure fuel pump can be prevented, so that cooling of the high-pressure fuel pump by means of a fuel scavenging flow, which always requires a return line to the fuel tank, can be avoided. Omitting such a fuel return line not only simplifies the entire layout of the fuel delivery system but also increases safety in the case of a dangerous collision. Besides, unnecessary heating of the fuel in the fuel tank by the fuel scavenging flow that would be heated in the high-pressure fuel pump is avoided, resulting in reduced vaporization losses in the fuel tank and thus relieving the activated charcoal filters and tank venting system.

In an especially advantageous feature of the invention, it is provided that for cooling, a coolant liquid can be delivered as coolant medium to the high-pressure fuel pump through the coolant conduit. Although it is fundamentally possible to use any suitable coolant liquid, such as, in a climate control system present in a vehicle, the refrigerant from the climate control system, for cooling the high-pressure fuel pump of the vehicle engine, it is preferable to provide coolant water as the coolant medium; the coolant water is preferably diverted from the cooling system of the internal combustion engine.

By using coolant water, and especially by using a partial stream of coolant water that is derived from the forward flow part of the cooling system of the engine, that is, downstream of the engine radiator, cooling of the high-pressure fuel pump can be improved still further.

It is expedient if for controlling the delivery of coolant water, a blocking valve is provided, which is actuatable by a control circuit as a function of the temperature of the coolant water and the temperature of the high-pressure fuel pump.

In the event that under extreme operating conditions of the engine the cooling of the high-pressure fuel pump cannot be performed or is inadequate to prevent vapor bubble development, it is advantageously provided that a pressure regulator device, controllable by a control circuit, is connected to the output side of the fuel feed pump, to enable adjusting the fuel pressure delivered to the high-pressure fuel pump on the low-pressure side, that is, the pilot pressure, as a function of the operating conditions of the high-pressure fuel pump.

Expediently, the pressure regulator device is controllable such that the pressure delivered to the low-pressure side of the high-pressure fuel pump can be regulated to a first or a second value. However, it can also be provided that the regulated pressure delivered to the low-pressure side of the high-pressure fuel pump is variable.

To assure safe operation of the high-pressure fuel pump even in extreme cases, expediently at least two coolant conduits are provided, of which one delivers air and the other water as coolant medium to the high-pressure fuel pump.

BRIEF DESCRIPTION OF THE DRAWINGS

Other features and advantages of the invention will become apparent from the detailed description contained below, taken in conjunction with the drawings, in which.

DESCRIPTION OF THE PREFERRED EMBODIMENTS

Figure 1:
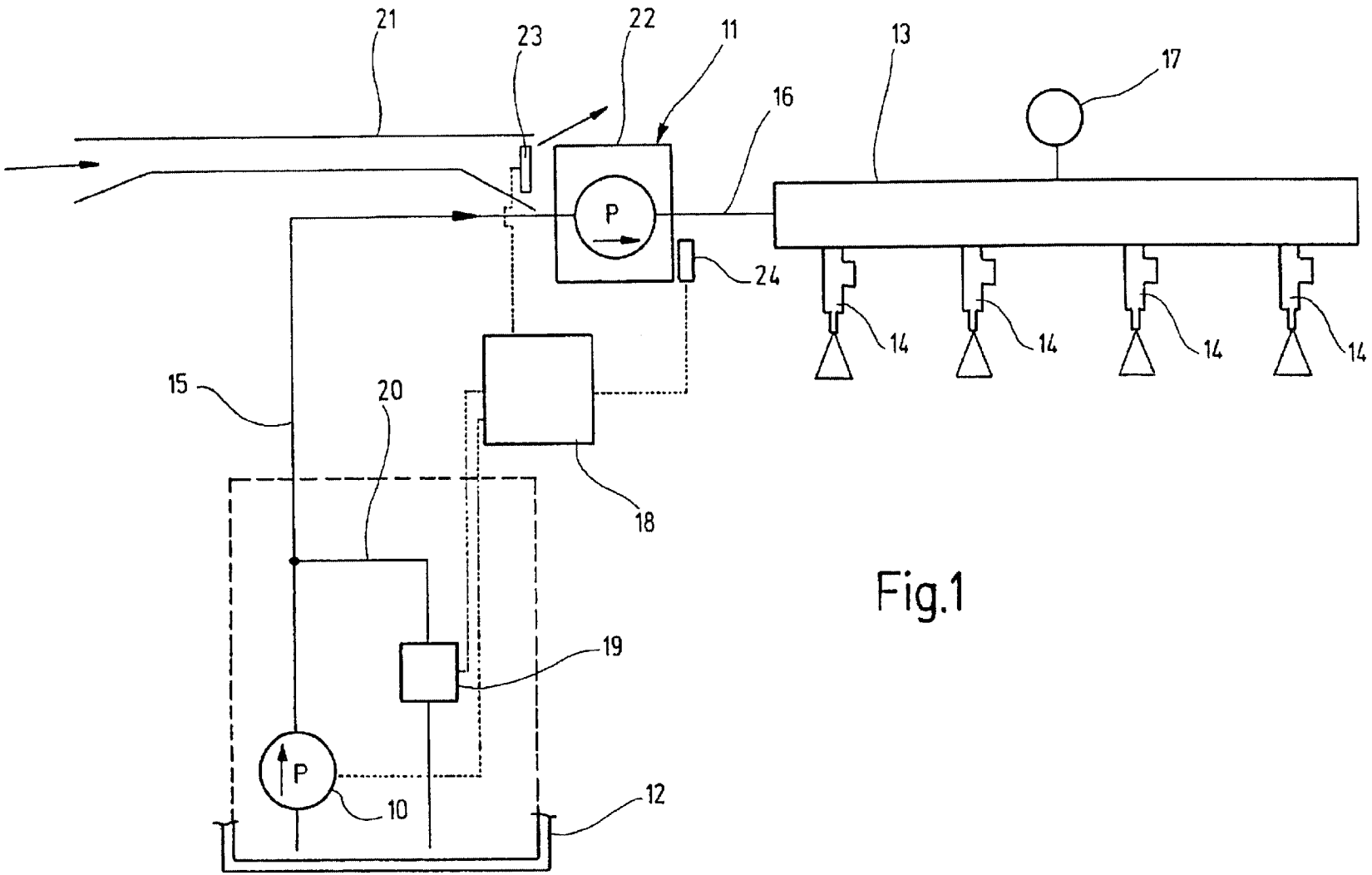
FIG. 1, a schematic, simplified block diagram of a fuel delivery system of the invention, with an air-cooled high-pressure fuel pump.

In the various drawing figures, components corresponding to one another are identified by the same reference numerals.

As FIG. 1 shows, a fuel delivery system of the invention has a fuel feed pump 10 and a high-pressure fuel pump 11, in order to furnish fuel from a fuel tank 12 via a pressure line system 13 to one or more injection valves 14 of an internal combustion engine. In the exemplary embodiment shown, the assumption is a four-cylinder internal combustion engine, in which each combustion chamber is assigned one injection valve, which injects fuel either directly into the combustion chamber or into its intake region.

The fuel feed pump 10, which is driven in a manner not shown in detail by an electric motor, has its compression side in communication, via a pressure line 15, with a low-pressure side of the high-pressure pump 11. The output or high-pressure side of the high-pressure pump 11 is connected via a further pressure line 16 to the pressure line system 13, to which a pressure sensor 17 is assigned, whose output signal, corresponding to the fuel pressure in the pressure line system 13, is delivered to a control circuit 18, which in a manner not shown monitors the operating conditions of the engine and as a function thereof controls the various engine operating parameters, such as the instant of ignition, instant of injection, fuel quantity to be injected, and the like.

In order for fuel to be supplied at a certain regulated pilot pressure to the low-pressure side of the high-pressure pump 11 via the pressure line 15, a pressure regulator device is assigned to the fuel feed pump 10. This pressure regulator device can be formed for instance by the fuel feed pump 10 itself, if its feeding capacity is adjustable, to enable controlling it as a function of demand.

In the exemplary embodiment shown, a pressure regulator 19 is provided as the pressure regulator device; it communicates with the pressure line 15 via a line 20. The outlet side of the pressure regulator 19 returns excess fuel to the fuel tank 12. The pressure regulator 19 can be made reversible in such a way that it limits the pilot pressure in the pressure line 15 either to a first, relatively low value, such as about 3 bar, or to a second, relatively high value, such as 8 to 10 bar. However, it is also possible to provide a pressure regulator 19 which is controllable such that it can limit the pilot pressure in the pressure line 15 to practically any arbitrary value between a first, relatively low and a second, relatively high value. To that end, the pressure regulator 19 is embodied such that the limiting pressure, that is, the pressure to which the pilot pressure in the pressure line 15 is set, is adjustable with the aid of the pumping capacity of the fuel feed pump 10.

To prevent vapor bubble development in the high-pressure pump 11, one or more coolant conduits 21, only one of which is shown, are provided, through which a coolant medium flow is carried to a pump housing 22 shown purely schematically. In the exemplary embodiment shown in FIG. 1, the coolant conduit or conduits 21 serve to deliver ambient air to the pump housing 22, which in a manner not shown in further detail has heat dissipation surfaces, such as cooling fins or the like, at which the cooling air flow carried through the coolant conduit or conduits absorbs heat from the pump housing and carries it away.

Expediently, a fan 23, which can preferably be controlled on demand by the control circuit 18, is disposed in the coolant conduit or coolant conduits. If there are more than one coolant conduit, then expediently one fan is disposed in a common region of the coolant conduits in such that it generates the cooling air flow in all the coolant conduits.

To control the cooling air flow on demand via the fan 23 that is controllable by the control circuit 18, a temperature sensor 24 for monitoring the temperature of the high-pressure pump 11 is disposed in or on the pump housing 22, and its output signal is delivered to the control circuit 18.

During normal engine operation, fuel at a relatively low pilot pressure is furnished by the fuel feed pump 10 via the pressure line 15 to the high-pressure pump 11, which via the pressure line system 13 supplies the injection valves 14 with fuel that is at high pressure. In the process, the high-pressure pump 11 is cooled by the cooling air flow carried in the coolant conduit or coolant conduits, so that the temperature of the high-pressure pump is kept below the critical operating temperature, at which vapor bubble development in the fuel ensues.

If the temperature of the high-pressure pump 11 under certain engine operating conditions rises, then first the cooling is intensified, in that the fan 23 is turned on by the control circuit 18 or is switched over to a higher operating stage that brings about a greater cooling air flow.

However, if no intensification of the cooling is possible, or if the temperature of the pump housing 22 or the high-pressure pump 11 continues to rise despite increased cooling and exceeds the critical operating temperature, then the control circuit 18 causes an elevation of the pilot pressure in the pressure line 15. To that end, the control circuit 18 establishes a higher pumping capacity of the fuel feed pump 10 and switches the pressure regulator 19 over in such a way that it limits the pilot pressure in the pressure line 15 to a relatively high value.

If a pressure regulator 19 is used in which the magnitude of the limiting pressure depends on the flow rate, then by suitable control of the pumping capacity of the fuel feed pump 10, it is possible to set the pilot pressure in the pressure line 15 to practically any arbitrary value between the lower, normal pilot pressure and a maximum allowable, upper pilot pressure. This makes it possible to raise the pilot pressure in the pressure line 15 each time only far enough that the pressure-dependent critical operating temperature of the high-pressure pump is kept just above the temperature of the high-pressure pump.

Figure 2:
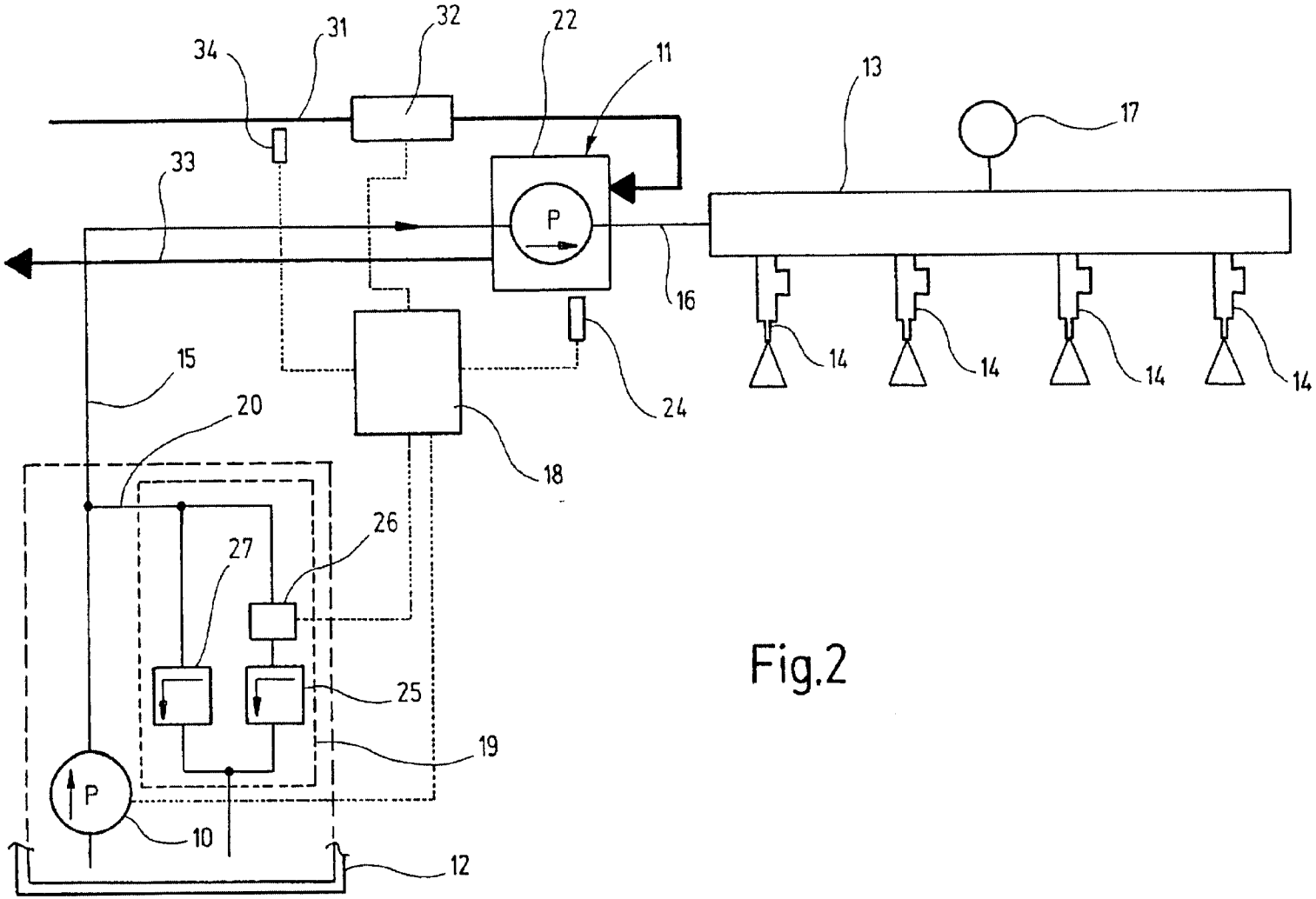
FIG. 2, a schematic, simplified block diagram of a fuel delivery system of the invention, with a high-pressure fuel pump cooled with a liquid coolant medium, such as water.

FIG. 2 shows a different embodiment of a fuel delivery system of the invention, in which fuel from a tank 12 is furnished by a feed pump 10 via a pressure line 15 to a high-pressure pump 11, which delivers fuel at high pressure via a further pressure line 16 to a pressure line system 13, to which one or more injection valves 14 are connected for injecting fuel into the combustion chambers of an internal combustion engine, or into its intake region. To enable adjusting the pilot pressure in the pressure line 15 to suit the operating conditions of the high-pressure pump 11, a pressure regulator 19 communicates with the pressure line 15 via a line 20. The pressure regulator 19 includes a first pressure limiting valve 25, whose inlet side communicates with the pressure line 15 via a valve device 26 and the line 20. The first pressure limiting valve 25 serves to limit the pilot pressure to a first, low value during normal operation. Parallel to the first pressure limiting valve 25, there is a second pressure limiting valve 27, which limits the pilot pressure in the pressure line 15 to a second, maximum value, such as 8 to 10 bar.

The valve device 26 can in the simplest case be a blocking valve, so that the pressure regulator 19 can be switched over in such a way that it limits the pilot pressure to either the normal value or the maximum value. However, it is also possible for the valve device 26 to be a throttle device, which has a throttle valve that is embodied such that as the fuel flowing through increases, the flow resistance increases disproportionately, so that the limiting pressure can be controlled as a function of the pumping capacity of the fuel feed pump 10.

For cooling the high-pressure pump 11, a coolant conduit 31 is provided, by way of which a liquid coolant medium, such as coolant water from the engine cooling system or refrigerant from a refrigerant cycle of a climate control system, is carried to the high-pressure pump 11. The coolant conduit 31, in which a blocking valve 32 is disposed that can be actuated by a control circuit 18, discharges into a coolant conduit, not identified by reference numeral, in the interior of a pump housing 22 of the high-pressure pump 11. The outlet of the coolant conduit provided in the pump housing 22 communicates with the engine cooling system or the climate control system via a return line 33. If a partial flow of coolant water is diverted from the engine cooling system in order to cool the high-pressure pump 11, then the coolant conduit 31 expediently communicates with the forward flow part of the engine cooling system, that is, the outlet side of the radiator, while the return line 33 preferably discharges upstream of the radiator.

To detect the temperature of the high-pressure pump 11, a temperature sensor 24 is disposed in or—as shown—on the pump housing 22. For detecting the coolant water temperature, a further temperature sensor 34 is mounted in or on the coolant conduit 31. The output signals of the temperature sensors 24 and 34 are carried to the control circuit 18.

Figure 3:
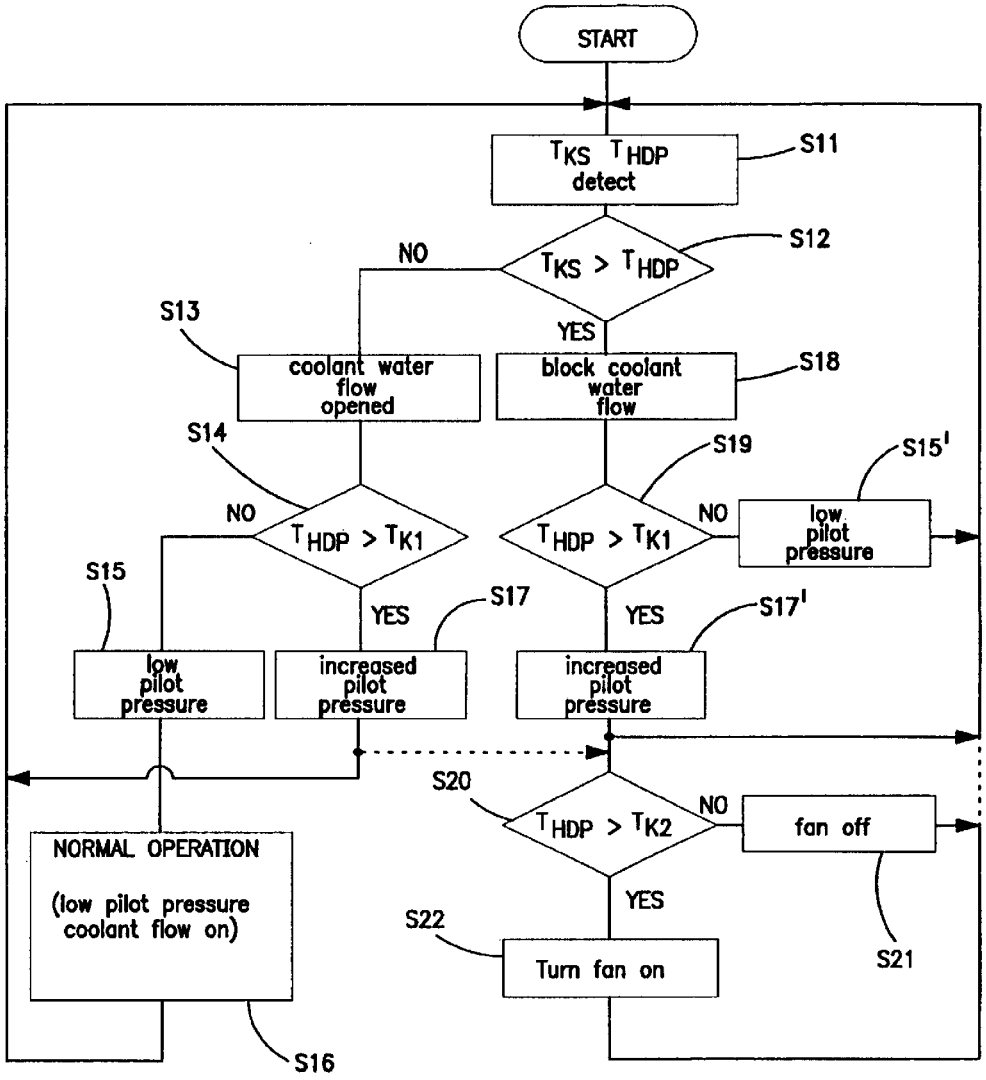
FIG. 3 a flow chart for the operation of a fuel delivery system of the invention, in which the pilot pressure can be regulated and the high-pressure fuel pump can be cooled with a controllable coolant medium flow.

The mode of operation of the fuel delivery system shown in FIG. 2 during normal operation of an internal combustion engine will now be described in conjunction with FIG. 3.

As soon as the engine is started, that is, as soon as the starting phase has ended and the high-pressure pump 11 supplies the injection valves 14, via the pressure line system 13, with fuel at high pressure, the cooling of the high-pressure pump 11 is actuated as well. After the cooling control has started, first in step S11 the temperature $T_{KS}$ of the flow of coolant water is ascertained with the aid of the temperature sensor 34, and the temperature $T_{HDP}$ is ascertained with the aid of the temperature sensor 24. In step S12, it is ascertained whether the temperature $T_{KS}$ of the coolant water is higher than the temperature $T_{HDP}$ of the high-pressure pump 11. Since normally this is not the case, the control proceeds to step S13, in which it is asked whether the coolant flow is opened, i.e., whether the blocking valve 32 in the coolant conduit 31 is opened. If not, then the blocking valve 32 is opened. After that, in step S14, it is ascertained whether the temperature $T_{HDP}$ of the high-pressure pump 11 is higher than a first critical operating temperature $T_{k1}$. If not, then in step S15 the question is asked whether the low pilot pressure in the pressure line 15 is set, and if not, it is so set. In step S16, normal operation is thus detected, and the control returns to step S11, in order to detect the temperature $T_{KS}$ of the coolant water and the temperature $T_{HDP}$ of the high-pressure pump again.

If in step S14 it is ascertained that the temperature $T_{HDP}$ of the high-pressure pump 11 is higher than the critical operating temperature $T_{k1}$, then the control proceeds to step S17 and raises the pilot pressure in the pressure line 15 by means of a suitable control of the pressure regulator 19 and/or of the fuel feed pump 10. As soon as the pilot pressure has been raised, the temperature monitoring proceeds in step S11.

If it is ascertained, under extreme operating conditions, that the temperature $T_{KS}$ of the coolant water flow is higher than the temperature $T_{HDP}$ of the high-pressure pump 11, then at step S12 the control skips to step S18 and blocks off the coolant flow with the aid of the blocking valve 32. Next, in step S19, it is asked whether the temperature $T_{HDP}$ is higher than the critical operating temperature $T_{k1}$. If not, then in step S15' the low pilot pressure is set, and the control continues with the temperature monitoring.

However, if the temperature $T_{HDP}$ of the high-pressure pump 11 does exceed the critical operating temperature $T_{k1}$, then in step S17', by means of the control circuit 18 and with the aid of the pressure regulator 19 and/or the fuel feed pump 10, the pilot pressure in the pressure line 15 is raised. Next, the process continues again in step S11 with the temperature monitoring.

If in the fuel delivery system shown in FIG. 2, not only the coolant medium flow shown but also air cooling with a fan 23 controllable by the control circuit 18 is provided, as shown in FIG. 1, then in operation of the fuel delivery system, after an elevation of pilot pressure in step S17 or S17', the question is additionally asked whether the temperature $T_{HDP}$ of the high-pressure pump 11 is greater than a second, higher critical operating temperature $T_{k2}$. If not, then in step S21 the fan is turned off or is kept off, and the control returns to the temperature monitoring in step S11. However, if in step S20 it is ascertained that the temperature $T_{HDP}$ of the high-pressure pump 11 is higher than the second, upper critical operating temperature $T_{k2}$, then in step S22 the fan 23 is turned on, so that the temperature monitoring can continue in step S11 thereafter.

In the described mode of operation of the fuel delivery system of the invention, the duration of the coolant flow blocking and of the pilot pressure elevation and the duration of fan operation are dependent on temperature conditions. However, with the aid of suitable timers, it is also possible to specify a fixed or variable duration for the coolant flow blocking, pilot pressure elevation, and fan operation. In the process, the fuel throughput through the high-pressure pump 11, which is dependent on engine operation and causes additional cooling of the high-pressure pump 11, can be taken into account as well.

Since the critical operating temperatures $T_{k1}$ and $T_{k2}$ are dependent not only on the pilot pressure that is exerted from outside but also, predominantly, on the vapor pressure of the fuel and in particular the vapor pressure of the individual fuel components, and hence are also dependent on the fuel composition, the definition of the critical operating temperatures $T_{k1}$, $T_{k2}$ for operation of the high-pressure pump 11 is done taking into account the applicable current pilot pressure and taking into account the fuel used, with a suitable safety margin. In order to take the fuel into account in defining the critical operating temperatures, fresh fuel that is ready to evaporate could be detected and taken into account, for instance via a fuel warning indicator, for which a fuel gauge is for instance evaluated. If the fuel vapor pressure is known either from a model or by measurement, then more-precise adaptation of the critical operating temperatures to the boiling point of the particular fuel used is possible.

Instead of the direct measurement of the temperatures $T_{KS}$ and $T_{HDP}$ of the coolant flow and of the high-pressure pump 11, as shown, these temperatures can also be estimated, using suitable models, from known variables such as the engine temperature, aspirated air temperature, vehicle speed, triggering of the engine fan, and so forth.

By means of the cooling of the high-pressure pump 11 as provided for according to the invention, its temperature $T_{HDP}$ is kept below the first critical operating temperature $T_{k1}$ for the great majority of the engine operating time. Thus for the great majority of the engine operating time, a low pilot pressure is sufficient. Only under extreme operating conditions must a pressure switchover accordingly be done. As a result, in particular the load on the fuel feed pump 10, which functions with an electric motor, is reduced considerably, thus increasing its service life. Furthermore, the average power consumption of the fuel feed pump 10, i.e. of the electric motor driving the fuel feed pump 10, is reduced markedly, thus lessening the burden on the on-board electrical system and reducing fuel consumption and tank heating as well.

The foregoing relates to preferred exemplary embodiment of the invention, it being understood that other variants and embodiments thereof are possible within the spirit and scope of the invention, the latter being defined by the appended claims.

What is claimed is:

1. A fuel delivery system for an internal combustion engine comprising a fuel feed pump (10), which delivers fuel which is at pilot pressure to a high-pressure fuel pump (11) that communicates on the high-pressure side with at least one injection valve (14), in order to deliver fuel at high pressure to the injection valve or valves (14), and means for delivering a coolant medium flow to the high-pressure fuel pump (11) via at least one coolant conduit (21, 31), in order to keep the temperature ($T_{HDP}$) of the high-pressure fuel pump (11) below a critical operating temperature ($T_{k1}$), said means for delivering a coolant medium flow including means for controlling the coolant medium flow as a function of the temperature of the high-pressure fuel pump (11) and the critical operating temperature ($T_{k1}$).

2. The fuel delivery system of claim 1, wherein for cooling, air is delivered as a coolant medium to the high-pressure fuel pump (11) through the coolant conduit (21).

3. The fuel delivery system of claim 2, further comprising a fan (23) associated with the at least one coolant conduit, for generating the cooling air flow through the coolant conduit (21).

4. The fuel delivery system of claim 3, wherein said fan (23) is controllable by said means for controlling the coolant medium flow as a function of the temperature of the high-pressure fuel pump (11) and the critical operating temperature ($T_k$).

5. The fuel delivery system of claim 1, wherein for cooling, a coolant liquid is delivered as a coolant medium to the high-pressure fuel pump (11) through the coolant conduit (31).

6. The fuel delivery system of claim 5, wherein said coolant liquid is coolant water diverted from the cooling system of the engine.

7. A fuel delivery system for an internal combustion engine comprising a fuel feed pump (10), which delivers fuel which is at pilot pressure to a high-pressure fuel pump (11) that communicates on the high-pressure side with at least one injection valve (14), in order to deliver fuel at high pressure to the injection valve or valves (14), and means for delivering a coolant medium flow to the high-pressure fuel pump (11) via at least one coolant conduit (21, 31), in order to keep the temperature ($T_{HDP}$) of the high-pressure fuel pump (11) below a critical operating temperature ($T_{k1}$), further comprising a blocking valve (32) for controlling the delivery of coolant medium said blockage valve being actuatable by a control circuit (18) as a function of the temperature ($T_{KS}$) of the coolant medium and the temperature ($T_{HDP}$) of the high-pressure fuel pump (11).

8. The fuel delivery system of claim 6, further comprising a blocking valve (32) for controlling the delivery of coolant medium, said blockage valve being actuatable by said means for controlling the coolant medium flow as a function of the temperature ($T_{KS}$) of the coolant medium and the temperature ($T_{HDP}$) of the high-pressure fuel pump (11).

9. The fuel delivery system of claim 1, further comprising a pressure regulator device (19) assigned to said low-pressure fuel pump (10), in order to enable adjusting the fuel pressure delivered to the high-pressure fuel pump (11) on the low-pressure side.

10. The fuel delivery system of claim 9, wherein said pressure regulator device (19) is connected on the output side to the fuel feed pump (10) and is controllable by said means for controlling the coolant medium flow.

11. The fuel delivery system of claim 10, wherein said pressure regulator (19) is controllable such that the pressure delivered to the low-pressure side of the high-pressure fuel pump (11) can be limited to a first or a second value.

12. A fuel delivery system for an internal combustion engine comprising a fuel feed pump (10), which delivers fuel which is at pilot pressure to a high-pressure fuel pump (11) that communicates on the high-pressure side with at least one injection valve (14), in order to deliver fuel at high pressure to the injection valve or valves (14), and means for delivering a coolant medium flow to the high-pressure fuel pump (11) via at least one coolant conduit (21, 31), in order to keep the temperature ($T_{HDP}$) of the high-pressure fuel pump (11) below a critical operating temperature ($T_{k1}$), further comprising a pressure regulator device (19) assigned to said low-pressure fuel pump (10), in order to enable adjusting the fuel pressure delivered to the high-pressure fuel pump (11) on the low-pressure side, wherein said pressure regulator (19) is controllable such that the pressure delivered to the low-pressure side of the high-pressure fuel pump (11) can be regulated variably.

13. The fuel delivery system of claim 10, wherein said pressure regulator (19) has a first and a second pressure limiting valve (25, 27), which are connected in parallel and enable a pressure limitation to a first and a second pressure, respectively.

14. The fuel delivery system of claim 12, wherein said pressure regulator (19) has a first and a second pressure limiting valve (25, 27), which are connected in parallel and enable a pressure limitation to a first and a second pressure, respectively.

15. The fuel delivery system of claim 11, wherein said pressure regulator (19) has a first and a second pressure limiting valve (25, 27), which are connected in parallel and enable a pressure limitation to a first and a second pressure, respectively.

16. The fuel delivery system of claim 13, further comprising a blocking valve (26), actuatable by said means for controlling the coolant medium flow, connected in series with the pressure limiting valve (25) for the low pressure.

17. The fuel delivery system of claim 16, further comprising a controllable throttle device connected in series with the pressure limiting valve (25) for the low pressure.

18. The fuel delivery system of claim 17, wherein said throttle device has a throttle valve, which is embodied such that the flow resistance increases disproportionately as the quantity of fuel flowing through increases.

19. The fuel delivery system of claim 1, comprising at least two coolant conduits (21, 31) of which one coolant conduit (21) delivers air and another coolant conduit (31) delivers water as coolant medium to the high-pressure fuel pump (11).

20. The fuel delivery system of claim 7, further comprising a pressure regulator device (19) assigned to said low-pressure fuel pump (10), in order to enable adjusting the fuel pressure delivered to the high-pressure fuel pump (11) on the low-pressure side.

* * * * *

UNITED STATES PATENT AND TRADEMARK OFFICE

CERTIFICATE OF CORRECTION

PATENT NO. : 6,840,219 B2
DATED : January 11, 2005
INVENTOR(S) : Klaus Joos et al.

It is certified that error appears in the above-identified patent and that said Letters Patent is hereby corrected as shown below:

Title page,
Item [56], References Cited, U.S. PATENT DOCUMENTS, please add the following:
-- 4,728,306 A 3/1988 Schneider……123/456 --
FOREIGN PATENT DOCUMENTS, please add the following:
-- FR 2546971 A 12/1984
JP 11-218057 A 8/1999 --

Signed and Sealed this

Nineteenth Day of April, 2005

JON W. DUDAS
*Director of the United States Patent and Trademark Office*